US008816934B2

(12) United States Patent
Nilsson

(10) Patent No.: US 8,816,934 B2
(45) Date of Patent: Aug. 26, 2014

(54) ANTENNA ASSEMBLY HAVING REDUCED PACKAGING SIZE

(75) Inventor: Jack Nilsson, Medina, OH (US)

(73) Assignee: MP Antenna, Ltd., North Ridgeville, OH (US)

( * ) Notice: Subject to any disclaimer, the term of this patent is extended or adjusted under 35 U.S.C. 154(b) by 403 days.

(21) Appl. No.: 13/194,343

(22) Filed: Jul. 29, 2011

(65) Prior Publication Data

US 2012/0026051 A1 Feb. 2, 2012

Related U.S. Application Data

(60) Provisional application No. 61/369,153, filed on Jul. 30, 2010.

(51) Int. Cl.
*H01Q 1/36* (2006.01)

(52) U.S. Cl.
USPC ..... 343/895; 343/752; 343/848

(58) Field of Classification Search
USPC ..... 343/752, 895, 846, 848
See application file for complete search history.

(56) References Cited

U.S. PATENT DOCUMENTS

| | | | | |
|---|---|---|---|---|
| 5,216,436 | A * | 6/1993 | Hall et al. | 343/895 |
| 6,011,524 | A * | 1/2000 | Jervis | 343/895 |
| 6,271,804 | B1 | 8/2001 | Yanagisawa et al. | |
| 6,559,811 | B1 * | 5/2003 | Pulimi et al. | 343/895 |
| 6,791,508 | B2 * | 9/2004 | Berry et al. | 343/895 |
| 2002/0097192 | A1 * | 7/2002 | Chang et al. | 343/895 |
| 2003/0210188 | A1 | 11/2003 | Hebron et al. | |
| 2003/0227422 | A1 | 12/2003 | Berry et al. | |
| 2006/0284779 | A1 | 12/2006 | Parsche et al. | |
| 2006/0290590 | A1 | 12/2006 | Takaoka et al. | |
| 2009/0289865 | A1 | 11/2009 | Parsche | |

FOREIGN PATENT DOCUMENTS

WO WO-03/030302 A1 4/2003

OTHER PUBLICATIONS

Pages i through 81 of the MSc Thesis of Idine Ghoreishian, submitted to the faculty of the Virginia Polytechnic Institute and State University entitled "The Spiro-Helical Antenna" (1999).
"Helical Feed Antennas", *Paul Wade* W1GHZ © 2002 w1ghz@arrl.net.

* cited by examiner

*Primary Examiner* — Tan Ho
(74) *Attorney, Agent, or Firm* — Tarolli, Sundheim, Covell & Tummino LLP

(57) ABSTRACT

An antenna assembly is provided, including a first radiative element. The first radiative element is oriented such that a first end of the radiative element is operatively connected to an antenna feed and at least a portion of the radiative element includes a first conical, helical coil. The first conical, helical coil reaches a maximum diameter at a point farthest from the antenna feed. A counterpoise structure includes one of an electrically conductive ground structure operatively connected to a ground associated with the antenna feed and a second radiative element operatively connected to the antenna feed and the first radiative element at the antenna feed.

25 Claims, 4 Drawing Sheets

ANTENNA ASSEMBLY HAVING REDUCED PACKAGING SIZE

RELATED APPLICATION

This application claims priority to U.S. Provisional Patent Application Ser. No. 61/369,153, filed Jul. 30, 2010, the entirety of which is hereby incorporated by reference.

TECHNICAL FIELD

Certain embodiments of the present invention relate to antennas for wireless communications. More particularly, certain embodiments of the present invention relate to an apparatus and method providing an antenna assembly of reduced size exhibiting polarization and spatial diversity for use in point-to-point and point-to-multipoint communication applications for the Internet, land, maritime, aviation, and space.

BACKGROUND OF THE INVENTION

Wireless communications have always struggled with limitations of audio, video, and data transport and internet connectivity in both obstructed and line-of-sight (LOS) deployments. A focus on antenna gain and transceiver processing solutions has proven to have significant limitations. While lower frequency radio waves benefit from low elevation propagation and higher frequencies do inherently benefit from reflection and penetration characteristics, due to topographical changes (hills & valleys) and obstructions, both natural and man-made, and the accompanying reflections, diffractions, refractions and scattering, the maximum signal received may well be off-axis, that is, received via a path that is not line-of-sight. Further, destructive interference of multipath signals can result in nulls and locations of diminished signal. Some antennas may benefit from having gain at one elevation angle to 'capture' signals of some pathways, while other antennas have greater gain at another elevation angle, each type being insufficient where the other does well. Radio waves can also experience altered polarizations as they propagate, reflect, refract, diffract, and scatter. A preferred polarization path may exist, but insufficient capture of the signal can result if this preferred path is not utilized.

BRIEF SUMMARY OF THE INVENTION

In accordance with an aspect of the invention, an antenna assembly is provided, including a first radiative element. The first radiative element is oriented such that a first end of the radiative element is operatively connected to an antenna feed and at least a portion of the radiative element includes a first conical, helical coil. The first conical, helical coil reaches a maximum diameter at a point farthest from the antenna feed. A counterpoise structure includes one of an electrically conductive ground structure operatively connected to a ground associated with the antenna feed and a second radiative element operatively connected to the antenna feed.

In accordance with another aspect of the invention, an antenna assembly having a characteristic wavelength associated with an operating frequency of the antenna is provided. A conical, helical radiative element has a first end operatively connected to an antenna feed. The conical, helical radiative element has a straightened length of approximately one-quarter to one-half of the characteristic wavelength and is configured to reach a maximum diameter at a point farthest from the antenna feed. An electrically conductive ground structure is operatively connected to a ground associated with the antenna feed.

In accordance with yet another aspect of the present invention, an antenna assembly having a characteristic wavelength associated with an operating frequency of the antenna is provided. A conical, helical radiative element has a first end operatively connected to an antenna feed. The conical, helical radiative element has a height above the connection to the antenna feed between four-hundredths of the characteristic wavelength and one-tenth of the characteristic wavelength and is configured to reach a maximum diameter at a point farthest from the antenna feed. An electrically conductive ground structure is operatively connected to a ground associated with the antenna feed.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 1:
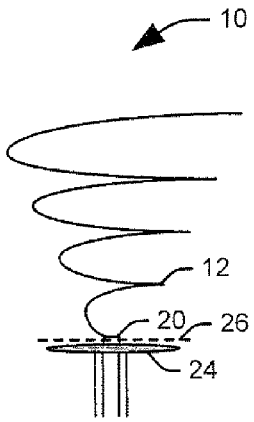
FIG. 1 illustrates a side view of an implementation of an antenna assembly for transmitting and receiving radio frequency signals in accordance with various aspects of the present invention.
Figure 2:
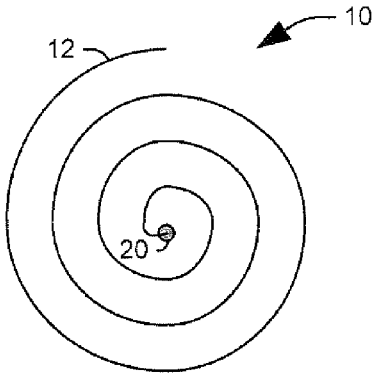
FIG. 2 illustrates a top view of the implementation of the antenna assembly of FIG. 1.

FIG. 1 illustrates a side view of an implementation of an antenna assembly 10 for transmitting and receiving radio frequency signals in accordance with various aspects of the present invention. FIG. 2 illustrates a top view of the implementation of the antenna assembly 10 in accordance with an aspect of the present invention, with a common numbering of common elements between the illustrations provided in FIGS. 1 and 2. It will be appreciated that the term "radio frequency," is intended to encompass frequencies within the microwave and traditional radio bands, specifically frequencies between 3 kHz and 3 THz. While the illustrated antenna assembly 10 is capable of some wideband performance, it will be appreciated that the antenna assembly 10 is tuned to a characteristic frequency, $\eta$, representing a frequency band to which the antenna is maximally receptive. Accordingly, the antenna assembly also has a characteristic wavelength, $\lambda$, equal to $c/\eta$ where c represents the speed of light, equal to approximately 300,000,000 m/s. It will be appreciated that the ability of the antenna assembly to be responsive to multiple polarizations can greatly improve the performance of the antenna, extending its useful range. For example, polarization diversity at the receive end increases the likelihood of capturing usable signal after the signal properties have been altered by obstructed pathways. Polarization diversity at the transmit end increases likelihood of a useable obstructed environment pathway (e.g., through nooks and crannies) to the receiver.

The antenna comprises a radiative element 12 having a first end electrically connected to an antenna feed 20. In accordance with an aspect of the invention, at least a portion of the first radiative element extends upward and outward from a connection point with the antenna feed 20 to form a conical, helical coil, with the first end of the radiative element 12 representing a tip of the conical helix formed by the element, and a second end of the antenna lying in a circumference of a largest coil of the helix. It will be appreciated that additional radiative elements or passive elements (not shown) can be utilized in the driven element in accordance with various implementations of the invention. In accordance with an aspect of the present invention, the radiative element 12 can have a total length ranging from one-quarter of the characteristic wavelength to one-half of the characteristic wavelength. The radiative element 12 can be formed from a length of conductive material having any appropriate cross-sectional shape. In one implementation, the radiative element 12 is flattened to provide superior wideband performance, such that a width of the conductive material along a first cross-sectional direction is significantly less than a width of the conductive material along a second cross-section direction orthogonal to the first cross-sectional direction.

Due to the helical design of the radiative element 12, a total height of the radiative element, for example, from the first end to a centerpoint of the base of the cone circumscribed by the conical, helical radiative element, where the base of the cone is coplanar with the second end of the radiative element, can be sharply reduced. For example, the total height of the radiative element 12 can range between four-hundredths of the characteristic wavelength of the antenna to a tenth of the characteristic wavelength, depending on the tightness with which the coils of the conical, helical radiative element are wound. The tightness of the coil, and the corresponding height, varies inversely with the performance to some extent, allowing for some room for trade-offs between the overall height of the antenna packaging and the performance of the antenna assembly. It will be appreciated, however, that even at the lower height of four-hundredths of a wavelength given above, the performance degradation is fairly minor and the performance of the antenna compares well with conventional designs that are much longer. Further, even the largest height of one-tenth of a wavelength given above represents a significant reduction in the profile of the antenna when compared to a standard quarter-wave implementation.

A counterpoise structure 24 can be operatively connected to either an antenna feed 20 or a ground connection associated with the antenna feed and located such that the counterpoise structure is located on a first side of an imaginary plane 26 passing through the antenna feed 20, and the radiative element 12 is located on a second side of the imaginary plane 26. It will be appreciated that the counterpoise structure 24 can comprise a second radiative element, operatively connected to the antenna feed and the first radiative element 12. Alternatively, as illustrated herein, the counterpoise structure 24 can comprise a ground structure connected to a ground associated with the antenna feed 20. In the illustrated implementation, the ground structure 24 is shown as a flat ground plane, but it will be appreciated that, where a ground structure is used, it can be configured in any of a number of ways. For example, a conical, hemispherical, or cylindrical ground structure can be utilized. Further, the ground structure does not need to be a single, solid structure, but can be implemented as a conductive mesh or comprise a number of discrete conductive elements evenly spaced around the antenna feed 20. In one implementation, the counterpoise structure can comprise ground shield of a coaxial feed.

An antenna in accordance with an aspect of the present invention provides a number of advantages over conventional designs. The conical, helical radiative element 12 provides a significant amount of inherent inductance and capitacance reactance and resistive impedance with a non-customary magnetic field, making it possible to provide a more compact, efficient antenna design. Rather than more standard, less-efficient field-signal-producing inductor/capacitor 'add-on' components/elements, the L, C properties are part of the radiating structure, increasing the efficiency of the antenna. Further, the illustrated antenna 10 provides a degree of vertical polarization near the horizon in all directions, and a horizontal polarized signal component directed upward, providing polarization diversity. Finally, the above benefits can be realized with a restricted ground reference, for example, with a radius as small as one-twentieth of the characteristic wavelength, about the radius of the top of the helical cone, greatly decreasing the footprint of the antenna assembly 10. Here, the coaxial shield serves as additional radiating counterpoise.

Alternatively, the ground plane may be larger, particularly for applications at different frequencies, such as with the metal roof of the car (HF to microwave applications), the common ground of a circuit board or radio enclosure/chassis (especially VHF and above), and the earth (shortwave, broadcast AM, and above), where with a shunt feed matching element added, the height is less than one-fifth the usual respective standard antenna heights. For example, an AM broadcast radio antenna tower could a height of fifty feet instead of the standard two hundred fifty foot height, and a military transworld/terrestrial/seas 30 KHz antenna would be very efficient at only approximately fifteen hundred feet long.

Figure 3:
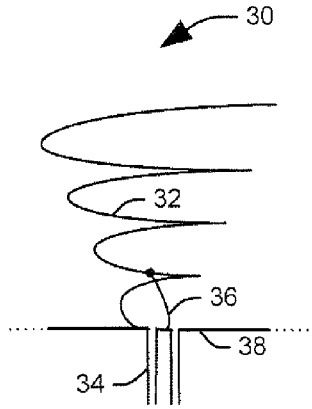
FIG. 3 illustrates a perspective view of an exemplary implementation of the antenna assembly.

FIG. 3 illustrates a perspective view of an exemplary implementation 30 of the antenna assembly. The illustrated antenna assembly 30 comprises a radiative element 32 having a first end electrically connected to a ground shield portion of an antenna feed 34. The radiative element 32 can be connected to a transmission line of the antenna feed 34 via a shunt feed 36 at a point intermediate to the first end and a second end of the radiative element. In accordance with an aspect of the invention, the first radiative element 32 extends from the connection with the antenna feed 34 to form a conical, helical coil, with the first end of the radiative element 32 representing a tip of the conical helix formed by the element, and the second end of the antenna lying in a circumference of a largest coil of the helix. The antenna assembly 30 further comprises a planar ground structure 38 operatively connected to a ground associated with the antenna feed 34. The ground structure 38 may be comprised of any appropriate electrically conductive material such as, for example, copper or stainless steel. The surface of the ground reference 38 may be continuous or may be a crosshatched wired mesh, in accordance with various embodiments of the present invention. In the illustrated example, a conductive structure associated with a vehicle or building upon which the antenna is mounted can be utilized as the ground structure 38. It will be appreciated that while FIG. 3 is illustrated with a coaxial feed, any of a variety of feed techniques can be used. For example, the antenna feed 34 can be a PCB feed, and the ground structure 38 can be the PCB common ground plane.

Figure 4:
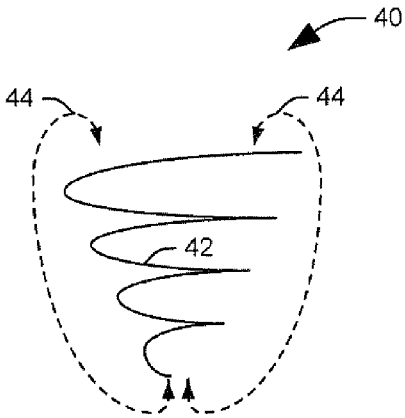
FIG. 4 illustrates a perspective view of an exemplary helical conical radiative element in accordance with an aspect of the present invention and a magnetic field produced by the conical, helical radiative element.

FIG. 4 illustrates a perspective view 40 of an exemplary helical conical radiative element 42 in accordance with an aspect of the present invention and a magnetic field 44 produced by the conical, helical radiative element. In the illustrated example, the magnetic field 44 is oriented such that the magnetic field lines proceed from the tip of the conical, helical assembly outwardly toward the perimeter of the largest coil of the helix. The field 44 has components in all three dimensions, such that the field lines are slanted relative to an axis of the conical assembly. It will be appreciated that the unconventional orientation of the magnetic field 44 of the illustrated conical, helical radiative element 42 allows for an antenna using the radiative element to operate in relatively close proximity to other, conventional antennas without significant inductive coupling. Similarly, capacitive coupling with proximate antennas is reduced due to division of the signal polarization.

Figure 5:
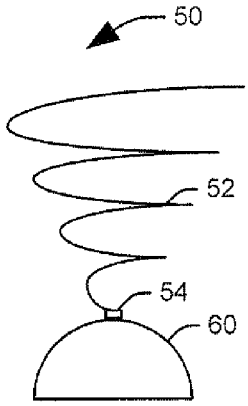
FIG. 5 illustrates a perspective view of an exemplary implementation of the antenna assembly.

FIG. 5 illustrates a perspective view of an exemplary implementation 50 of the antenna assembly. The illustrated antenna assembly 50 comprises a radiative element 52 having a first end electrically connected to an antenna feed 54. In accordance with an aspect of the invention, the first radiative element 52 extends from the connection with the antenna feed to form a conical, helical coif, with the first end of the radiative element 52 representing a tip of the conical helix formed by the element, and a second end of the antenna lying in a circumference of a largest coil of the helix. In the illustrated implementation, the antenna assembly 50 is configured to operate at a characteristic frequency of 2.4 GHz, and a corresponding characteristic wavelength of approximately 4.92 inches. The radiative element 52 can have a total (i.e., straightened) length of approximately three-tenths of the characteristic wavelength, or around 1.56 inches. In the illustrated implementation, the coil is wound such that a maximum height of the coil from the point of connection with the antenna feed at the tip of the cone to a centerpoint of the base of the cone is approximately 0.22 inches. In one implementation, the opening angle of the cone can be around 30 degrees.

The antenna assembly 50 further comprises a hemispherical or conical ground structure 60 operatively connected to a ground associated with the antenna feed 54. The ground structure 60 may be comprised of any appropriate electrically conductive material such as, for example, copper or stainless steel. The surface of the ground reference 60 may be continuous or may be a crosshatched wired mesh, in accordance with various embodiments of the present invention. The antenna feed 54 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect to the radiative element 52 and allows a ground braid of the coaxial cable to electrically connect to the hemispherical or conical ground structure 60. A dielectric material can be used to electrically insulate the center conductor and the radiative element 52 from the ground structure 60.

With the sidelength of the ground structure 60 being approximately a quarter of a characteristic wavelength of the antenna in length, the antenna 50 can be implemented to be around or less than one-half the length of standard antennas, while providing high overall performance. The illustrated ground structure is configured such that the coaxial cable does not radiate, and no additional matching element/component is needed.

Figure 6:
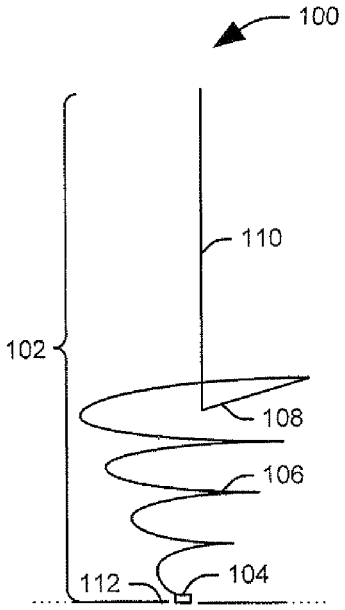
FIG. 6 illustrates a perspective view of a second exemplary implementation of an antenna assembly in accordance with an aspect of the present invention.

FIG. 6 illustrates a perspective view of a second exemplary implementation of an antenna assembly 100 in accordance with an aspect of the present invention. The illustrated antenna assembly 100 comprises a radiative element 102 having a first end electrically connected to an antenna feed 104. In accordance with an aspect of the invention, a first portion 106 of the radiative element 102 extends from the connection with the antenna feed as a conical, helical coil, with the first end of the first portion of the radiative element 102 representing a tip of the conical helix formed by the element, and a second end of the first portion of the radiative element lying in a circumference of a largest coil of the helix. A second portion 108 of the radiative element 102 comprises a first linear element extending substantially parallel to the plane of the largest coil from the second end the first portion 106 of the radiative element toward a center of the largest coil in the helix from the second end of the first portion 106 of the radiative element, such that a first end of the second portion is physically connected to the second end of the first portion and a second end of the second portion lies substantially at a center axis of the helix. A third portion 110 of the radiative element comprising a second linear segment extending from the second end of the second portion 108 of the radiative element away from the antenna feed in a direction perpendicular to the plane of the largest coil In the illustrated implementation, the antenna assembly 100 is configured to operate at a characteristic frequency of 27 MHz, and a corresponding characteristic wavelength of approximately 36 feet. The coil is thus wound such that a maximum height of the coiled first portion 102 of the radiative element from the point of connection with the antenna feed at the tip of the cone, to a centerpoint of the base of the cone is approximately two feet. With the addition of the third portion 110, which extends substantially perpendicularly from the plane of the base of the cone, the total height of the radiative element 102 is approximately four feet, with the conical, helical first portion 106 having a maximum diameter of around four inches. An appropriate conductive ground assembly 112, operatively connected to a ground associated with the antenna feed 104, can further be provided, such as the metal frame and/or roof of a vehicle or the metal rooftop of a building or a tuned ground plane, which can be fiat, hemispherical, cylindrical, otherwise shape and formed from multiple elements, mesh, or sheet metal.

Figure 7:
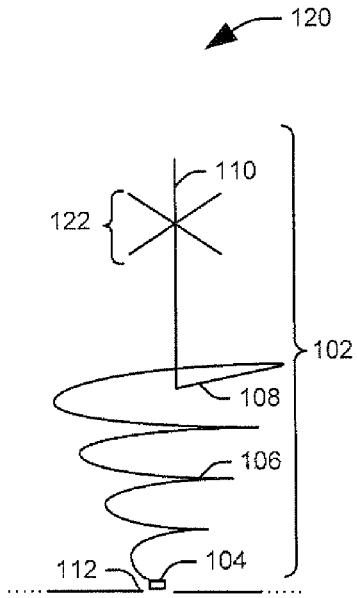
FIG. 7 illustrates a first variation of the antenna assembly of FIG. 4.

FIG. 7 illustrates a first variation 120 of the antenna assembly 100 of FIG. 6, in which a capacitance hat 122 is positioned at the third portion 110. In the illustrated example, the overall length of the third portion 110 of the radiative element is reduced, and a capacitance hat 120 is added at some point between the first end of the third portion and a second end, which can include the second end. For example, the capacitance hat 120 can comprise two linear elements arranged with their midpoints intersecting the third portion 110 of the radiative element as to be perpendicular to the third portion and one another.

Figure 8:
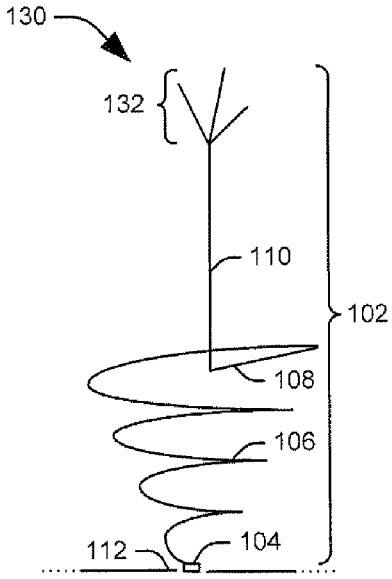
FIG. 8 illustrates a second variation of the antenna assembly of FIG. 4.

FIG. 8 illustrates a second variation 130 of the antenna assembly 100 of FIG. 6, in which a modified capacitance hat 132 is placed at the second end of the third portion 110. In the illustrated example, the overall length of the third portion 110 of the radiative element is reduced, and a modified capacitance hat 130 is added at a second end of the third portion. The modified capacitance hat 130 comprises three linear elements, extending from a common axis at oblique angles relative to one another and the third portion 110 of the radiative element. In the illustrated implementation, the linear elements are configured to provide additional spatial and polarization (particularly with the three linear elements being of different lengths) diversity for the antenna assembly.

Figure 9:
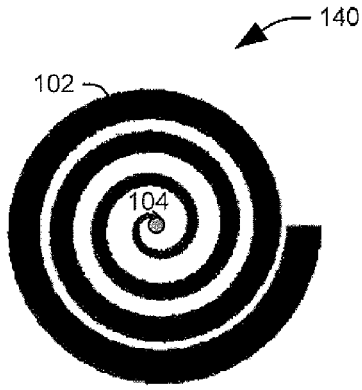
FIG. 9 illustrates a second variation of the antenna assembly of FIG. 4.

FIG. 9 illustrates a third variation 140 of the antenna assembly 100 of FIG. 6, in which the radiative element 102 extends as a length of conductive material to form a conical, helical coil, but the radiative element has a substantially flat cross-section. In other words, a width of the conductive material along a first cross-sectional direction is significantly less than a width of the conductive material along a second cross-section direction orthogonal to the first cross-sectional direction. It will be appreciated that FIG. 9 is shown along the first cross-sectional direction, which is substantially aligned with an axis of the conical, helical cone.

In the illustrated implementation, the width of the radiative element 102 along the second cross-sectional direction is greater at the first end of the radiative element than it is at the second end of the radiative element. For example, the width of the radiative element 102 along the second cross-sectional direction can increases continuously from the first end of the radiative element to the second end of the radiative element. In this implementation, the width at the second end is between five to ten times greater than the width at the first end. For example, the width can be around three-eighths of an inch at the first end and around three inches wide at the second end. It will be appreciated that configuring the radiative element 102 in this manner can provide a significant increase in the wideband performance provided by the antenna assembly 100.

Figure 10:
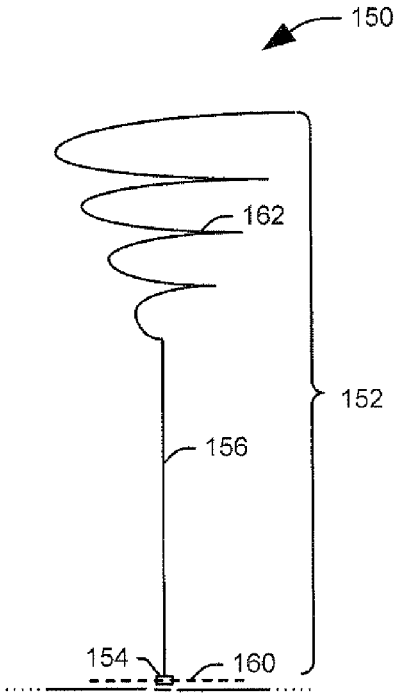
FIG. 10 illustrates a perspective view of a third exemplary implementation of an antenna assembly in accordance with an aspect of the present invention.

FIG. 10 illustrates a perspective view of a third exemplary implementation of an antenna assembly 150 in accordance with an aspect of the present invention. The illustrated antenna assembly 150 comprises a first radiative element 152 having a first end electrically connected to an antenna feed 154. In accordance with an aspect of the invention, a first portion 156 of the radiative element 152 comprises a linear segment extending from a first end, operatively connected with the antenna feed, in a direction substantially perpendicular to an imaginary plane 160 intersecting the antenna feed 154. A second portion 162 of the radiative element 152 comprises a conical, helical coil, with the first end of the second portion 162 of the radiative element 152 representing a tip of the conical helix formed by the element, and a second end of the first portion of the radiative element lying in a circumference of a largest coil of the helix. The second portion 162 of the radiative element 152 is connected at the first end to a second end of the first portion 156 of the radiative element, and extends away from the antenna feed 154 such that an axis of the conical, helical second portion 162 is substantially parallel to the first portion 156.

Figure 11:
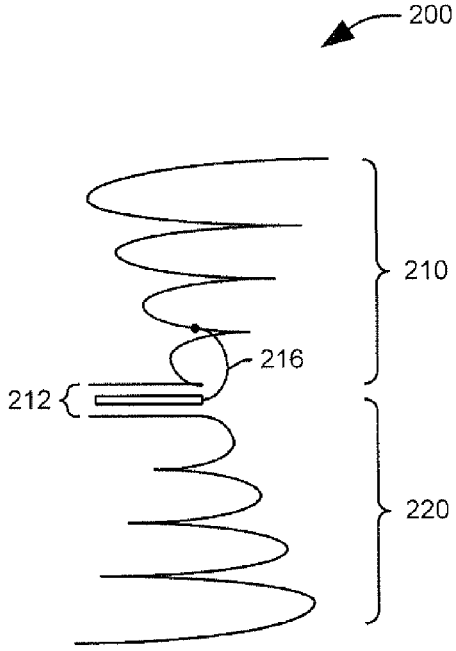
FIG. 11 illustrates a perspective view of a fourth exemplary implementation of an antenna assembly in accordance with an aspect of the present invention.

FIG. 11 illustrates a perspective view of a fourth exemplary implementation of an antenna assembly 200 in accordance with an aspect of the present invention. The illustrated antenna assembly 200 comprises a first radiative element 210 that extends from the antenna feed 212 to form a first conical, helical coil, with the first radiative element 210 representing a tip of the conical helix formed by the element, and a second end of the first radiative element lying in a circumference of a largest coil of the helix. The first radiative element 210 is connected to a ground shield of the antenna feed 212 at its first end, and connected to a transmission line of the antenna feed at a point between its first end and its second end through a shunt feed 216. A second radiative element 220 extends from the antenna feed to form a second conical, helical coil, with the first end of the second radiative element 220 representing a tip of the conical helix formed by the element, and a second end of the second radiative element lying in a circumference of a largest coil of the helix. The first and second radiative elements 210 and 220 are operatively connected to the ground shield of the antenna feed 212 at their respective first ends and extend from the antenna feed in generally opposing directions, such that an axis of the cone formed by the first radiative element 210 is substantially collinear with an axis of the cone formed by the second radiative element 220. While the illustrated implementation shows a coaxial shunt feed, alternatively twin-lead, circuit board style, and other (parallel) transmission line feeds may be used here and in other variations.

In the illustrated implementation, the antenna assembly 200 is configured to operate at a characteristic frequency of 2.4 GHz, and a corresponding characteristic wavelength of approximately 4.92 inches. The two radiative elements 210 and 220 can have a combined, straightened length of approximately 3.12 inches. In the illustrated implementation, the coils are wound such that a maximum height of the each portion 210 and 220 of the radiative element from a point of connection with the antenna feed 212 at the tip of the cone, to a centerpoint of the base of the cone is approximately 0.22 inches, and the opening angle of each cone can be around 30 degrees. It will be appreciated that the use of the two conical, helical radiative elements 210 and 220 allows for a substantially spherical radiation pattern with polarization diversity. The gain of the antenna assembly 200 rivals larger antennas, and the performance of the antenna assembly in an obstructed environment can be greater overall than much larger antennas.

Figure 12:
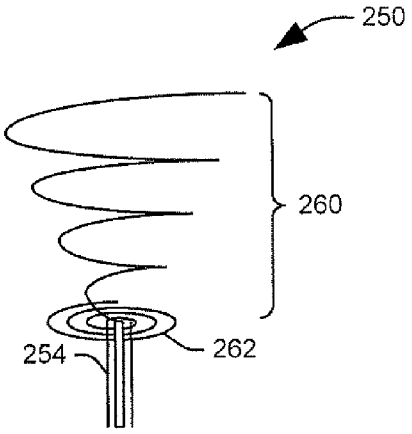
FIG. 12 illustrates a perspective view of a fifth exemplary implementation of an antenna assembly in accordance with an aspect of the present invention.

FIG. 12 illustrates a perspective view of a fifth exemplary implementation of an antenna assembly 250 in accordance with an aspect of the present invention. The illustrated antenna assembly 250 comprises a first radiative element 260 that extends from the connection with the antenna feed 254 to form a first conical, helical coil, with the first end of the first radiative element 260 representing a tip of the conical helix formed by the element, and a second end of the first radiative element lying in a circumference of a largest coil of the helix. A second radiative element 262 extends from the connection with the antenna feed and the first radiative element 260 to form an essentially planar spiral. The first and second radiative elements 260 and 262 are operatively connected to the antenna feed at respective first ends, with the axis of the cone formed by the conical, helical first radiative element 260 being substantially perpendicular to the plane defined by the spiral second radiative element 262.

In the illustrated implementation, the antenna assembly 250 is configured to operate at a characteristic frequency of 2.4 GHz, and a corresponding characteristic wavelength of approximately 4.92 inches. The first radiative element 260 can have a total (i.e., straightened) length of approximately 1.56 inches, with the coil wound such that a maximum height of the first radiative element 260 from a point of connection with the antenna feed 254 at the tip of the cone, to a centerpoint of the base of the cone is approximately 0.22 inches, and the opening angle of each cone is around 30 degrees. The spiral second radiative element 262 can have a straightened length of approximately one-quarter of the characteristic wavelength, or about 1.23 inches.

Figure 13:
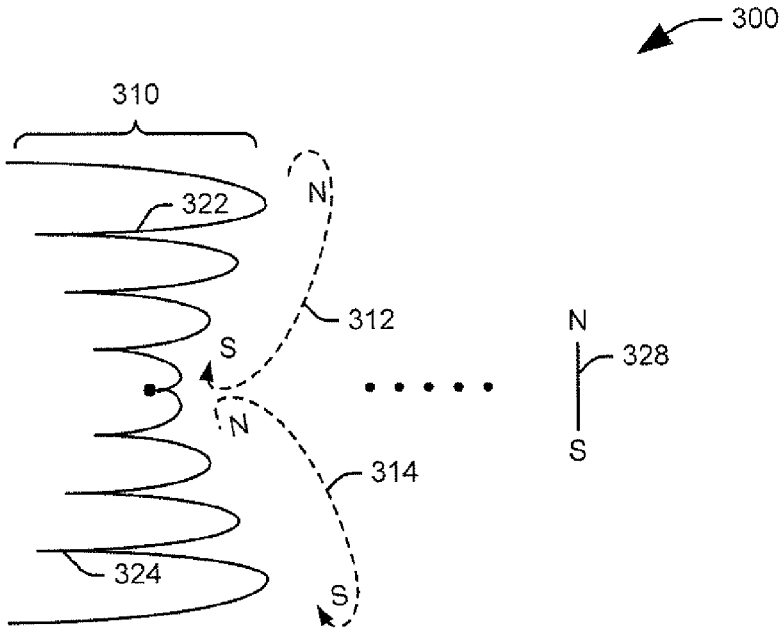
FIG. 13 illustrates a perspective view of a second antenna assembly and an associated magnetic field in accordance with an aspect of the present invention.

FIG. 13 illustrates a perspective view 300 of a first antenna assembly 310 and an associated magnetic field 312 and 314 in accordance with an aspect of the present invention. The antenna assembly 310 comprises a first conical, helical coil 322 having an associated first magnetic field 312 and a second conical, helical coil 324 having an associated second magnetic field 314. In the illustrated implementation, the first coil 322 is wound in a first direction (e.g., counter-clockwise), and the second coil is wound in the same direction. As described previously, the field 312 and 314 from each coil 322 and 324 has components in all three dimensions, such that the field lines are slanted relative to an axis of the conical assembly, but a primary component of each field is oriented within the plan of the page, running along the circumference of the coil, and is illustrated in cross section. At a reasonable distance from the assembly 300 within the plane of the page, the fields 312 and 314 from the two coils 322 and 324 sum into a unified field 328 oriented parallel to the axes of the coils.

Figure 14:
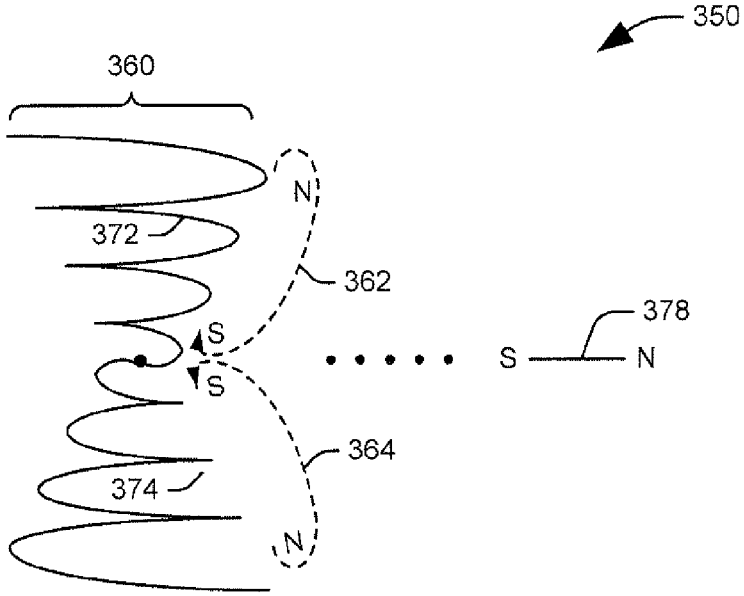
FIG. 14 illustrates a perspective view of a second antenna assembly and an associated magnetic field in accordance with an aspect of the present invention.

FIG. 14 illustrates a perspective view 350 of a second antenna assembly 360 and an associated magnetic field 362 and 364 in accordance with an aspect of the present invention. The antenna assembly 360 comprises a first conical, helical coil 372 having an associated first magnetic field 362 and a second conical, helical coil 374 having an associated second magnetic field 364. In the illustrated implementation, the first coil 372 is wound in a first direction (e.g., counter-clockwise), and the second coil is wound in a second direction (e.g., clockwise). As described previously, a primary component of the field 362 and 364 from each coil 372 and 374, as viewed in cross-section, runs along the circumference of the coil, but the poles of the magnetic field 364 of the second coil 374 are reversed relative to that of the first coil 372. Accordingly, the fields 372 and 374, as observed along the plane of the page, sum into a unified field 378 oriented perpendicular to the axes of the conical, helical coils 372 and 374, but within the plane of the page. It will thus be appreciated significant differences in the sensitivity of the antenna assembly can be altered by varying the winding of the two coils comprising the assembly.

Figure 15:
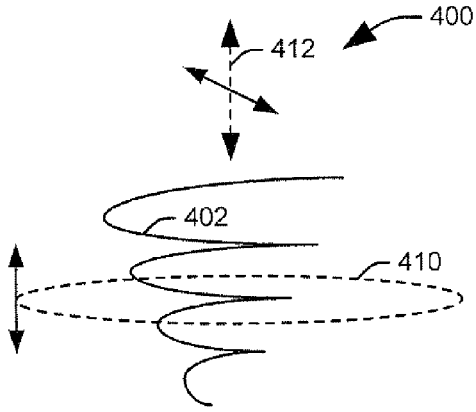
FIG. 15 illustrates a perspective view of an exemplary helical conical radiative element in accordance with an aspect of the present invention and components of the electric field produced by the conical, helical radiative element.

FIG. 15 illustrates a perspective view 400 of an exemplary helical conical radiative element 402 in accordance with an aspect of the present invention and components 410 and 412 of the electric field produced by the conical, helical radiative element. Similarly to a standard dipole antenna, the helical, conical element 402 provides a first electrical field component 410 aligned along the axis of the conical, helical radiative element 402 and propagating azimuthally from the axis. In accordance with an aspect of the present invention, the radiative element 402 also produces a second electrical field component 412, oriented orthogonally to the first electrical field component 410, that propagates along the axis of the radiative element 402. It will be appreciated that the additional electrical field component indicates both that the antenna will have substantially sensitivity in regions with higher elevation, as well as provide a spatially and polarization diverse signal that reduces the impact of interference on broadcast and received signals.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

Having described the invention, I claim:

1. An antenna assembly comprising:

a first radiative element, a first end of the radiative element being operatively connected to an antenna feed, the first radiative element having a height above the connection to the antenna feed between four-hundredths of the characteristic wavelength and one-tenth of the characteristic wavelength and being configured to reach a maximum diameter at a point farthest from the antenna feed; and a counterpoise structure comprising one of an electrically conductive ground structure operatively connected to a ground associated with the antenna feed and a second radiative element operatively connected to the antenna feed.

2. The antenna assembly of claim 1, the first radiative element having a straightened length of approximately three-tenths of a characteristic wavelength of the antenna.

3. The antenna assembly of claim 1, the counterpoise structure comprising one of a hemispherical or conical ground structure formed from one of a solid conductive material, a plurality of curvilinear elements, or a conductive mesh.

4. The antenna assembly of claim 1, the counterpoise structure comprising a planar ground structure.

5. The antenna assembly of claim 1, the counterpoise structure comprising the second radiative element, the second radiative element comprising a second conical, helical coil, wherein the second conical, helical coil reaches a maximum diameter at a point farthest from the antenna feed, an axis of a cone defined by the second radiative element being substantially collinear with an axis of a cone defined by the first radiative element.

6. The antenna assembly of claim 1, the counterpoise structure comprising the second radiative element, the second radiative element comprising a planar spiral coil, an axis of a cone defined by the first radiative element being substantially perpendicular to a plane of the spiral coil.

7. The antenna assembly of claim 1, the first radiative element comprising a first conical, helical coil being connected to the antenna feed at a first end and a first linear element, operatively connected at a first end to a second end of the first conical, helical coil, and extending from a circumference of a largest coil of the first conical, helical coil to a center of the largest coil, and a second linear element, extending from a second end of the first linear element in a direction perpendicular to the first linear element.

8. The antenna assembly of claim 7, the antenna assembly being configured to operate at a characteristic frequency of twenty-seven megahertz, the first radiative element having a total height of approximately four feet.

9. The antenna assembly of claim 7, the radiative element further comprising a capacitance hat operatively connected to a second end of the second linear element, the capacitance hat comprising third and fourth linear elements connected at their midpoints to the second end of the second linear element as to be perpendicular to one another and the second linear element.

10. The antenna assembly of claim 7, the radiative element further comprising a capacitance hat operatively connected to a second end of the second linear element, the capacitance hat comprising third, fourth, and fifth linear elements connected at a common apex at the second end of the second linear element and extending at oblique angles to one another and the second linear element.

11. The antenna assembly of claim 1, the first radiative element further comprising a first linear element operatively connected at a first end to the antenna feed and extending away from the antenna feed, the first conical, helical coil being operative connected to a second end of the first linear element.

12. The antenna assembly of claim 1, the first radiative element comprising a first conical, helical coil being operatively connected to the antenna feed at a first end, and a height of the first conical, helical coil from the antenna feed to a second end of the first conical, helical coil being approximately four-hundredths of a characteristic wavelength of the antenna.

13. The antenna assembly of claim 1, the radiative element extending as a length of conductive material having a substantially flat cross section, such that a width of the conductive material along a first cross-sectional direction is significantly less than a width of the conductive material along a second cross-section direction orthogonal to the first cross-sectional direction.

14. The antenna assembly of claim 13, wherein the width of the length of conductive material along the second cross-sectional direction is greater at a second end of the radiative element than the width of the length of conductive material along the second cross-sectional direction at the first end of the radiative element.

15. The antenna assembly of claim 14, wherein the width of the length of conductive material along the second cross-sectional direction increases continuously from the first end of the radiative element to the second end of the radiative element.

16. The antenna assembly of claim 14, wherein the width of the length of conductive material along the second cross-sectional direction is between five to ten times greater at the second end of the radiative element than at the first end of the radiative element.

17. An antenna assembly, having a characteristic wavelength associated with an operating frequency of the antenna, comprising:

a conical, helical radiative element, oriented such that a first end of the radiative element is operatively connected to an antenna feed, at least a portion of the radiative element comprising a conical, helical coil, wherein the conical, helical coil reaches a maximum diameter at a point farthest from the antenna feed; and a planar ground structure with a diameter less than one-tenth of the characteristic wavelength.

18. The antenna assembly of claim 17, the conical, helical radiative element being configured to have a height, from the antenna feed to the point farthest from the antenna feed, between four-hundredths of the characteristic wavelength and one-tenth of the characteristic wavelength.

19. The antenna assembly of claim 17, the conical, helical radiative element having a height above the connection to the antenna feed between four-hundredths of the characteristic wavelength and one-tenth of the characteristic wavelength.

20. The antenna assembly of claim 17, wherein the characteristic frequency is 2.4 GHz, and the straightened length of the conical, helical element is substantially equal to one and one-half inches.

21. An antenna assembly, having a characteristic wavelength associated with an operating frequency of the antenna, comprising:

a first conical, helical element, a first end of the first conical, helical element being operatively connected to a ground associated with an antenna feed, the first conical, helical element having a height less than one-tenth of the characteristic wavelength and reaching a maximum diameter at a point farthest from the antenna feed;

a shunt feed connecting the first conical, helical element to the antenna feed at a point remote from the first end; and a counterpoise structure operatively connected to the ground associated with the antenna feed.

22. The antenna assembly of claim 21, the counterpoise structure comprising one of a hemispherical ground structure and a conical ground structure, the ground structure having a sidelength substantially equal to one-quarter of the characteristic wavelength.

23. The antenna assembly of claim 21, further comprising a first linear element, operatively connected at a first end to a second end of the conical, helical element, and extending from a circumference of a largest coil of the conical, helical element to a center of the largest coil, and a second linear element, extending from a second end of the first linear element in a direction perpendicular to the first linear element.

24. The antenna assembly of claim 23, wherein the characteristic frequency is 27 MHz, and the total height of the conical, helical element, the first linear element, and the second linear element above the connection to the antenna feed is substantially equal to four feet.

25. The antenna assembly of claim 21, the counterpoise structure comprising a second conical, helical element, a first end of the second conical, helical element being connected to the first end of the first conical, helical element.

* * * * *